US006647567B1

(12) United States Patent
Baldwin et al.

(10) Patent No.: US 6,647,567 B1
(45) Date of Patent: Nov. 18, 2003

(54) PLUMBING PLUNGER SUPPORT AND STORAGE DEVICE

(76) Inventors: Dennis Baldwin, 1906 S. 250, West Perry, UT (US) 84302; Debra Baldwin, 1906 S. 250, West Perry, UT (US) 84302

( * ) Notice: Subject to any disclaimer, the term of this patent is extended or adjusted under 35 U.S.C. 154(b) by 0 days.

(21) Appl. No.: 10/229,892

(22) Filed: Aug. 29, 2002

(51) Int. Cl.[7] ..... E03D 11/00

(52) U.S. Cl. ..... 4/661; 4/255.01; 4/255.11; D6/551

(58) Field of Search ..... 4/661, 255.01, 4/255.04–255.12; D6/524, 551; 15/160, 184; 206/225, 349, 394

(56) References Cited

U.S. PATENT DOCUMENTS

| | | | | | |
|---|---|---|---|---|---|
| 5,456,356 | A | * | 10/1995 | Kurzawa | 4/255.11 |
| D368,820 | S | | 4/1996 | Sander | D6/551 |
| D370,376 | S | | 6/1996 | Midsud | D6/551 |
| 5,927,492 | A | | 7/1999 | Moore | 206/349 |
| D419,019 | S | * | 1/2000 | Shafik | D6/551 |
| 6,038,709 | A | | 3/2000 | Kent | 4/255.05 |
| D423,844 | S | * | 5/2000 | Bruns et al. | D6/524 |
| 6,193,059 | B1 | | 2/2001 | Massaro | 206/225 |

* cited by examiner

*Primary Examiner*—Tuan N. Nguyen
(74) *Attorney, Agent, or Firm*—Sturm & Fix LLP

(57) ABSTRACT

A support and storage device (10) for a plumber's plunger (100) wherein the device (10) includes a base unit (11) having a floor panel (21) connected to truncated cylindrical sidewalls (24) by a skirt element (25) to form a base housing member (20) wherein the bottom surface (22) of the floor panel (21) is provided with a plurality of support legs (23) and the top surface (28) of the floor panel (21) is provided with a plurality of drying ribs (40). In addition, the device (10) includes a front cover unit (12) adapted to cover one half of the base unit (11) and including a contoured front cover member (30) having a semi-cylindrical lower portion (31) and a semi-frustro conical upper portion (32) which covers almost the entire plunger (100) with the exception of the plunger handle (101).

6 Claims, 2 Drawing Sheets

PLUMBING PLUNGER SUPPORT AND STORAGE DEVICE

BACKGROUND OF THE INVENTION

CROSS REFERENCE TO RELATED APPLICATIONS

Not applicable.

1. Field of the Invention

The present invention relates to the field of plumbing plunger support devices in general and in particular to a plunger support and storage device that only partially conceals the plunger during storage to promote rapid drying and odor dissipation.

2. Description of Related Art

As can be seen by reference to the following U.S. Pat. Nos. 6,193,059; 5,927,492; 6,038,709; Des. 368,820; and, Des. 370,376, the prior art is replete with myriad and diverse plumbing plunger support and storage arrangements.

While all of the aforementioned prior art constructions are more than adequate for the basic purpose and function for which they have been specifically designed, they are uniformly deficient with respect to their failure to provide a simple, efficient, and practical plumbing plunger that both visually obscures a plunger as well as promotes air circulation around the open end of the plunger to quickly dry out the interior of the plunger bell and minimize odor problems as well as the propagation of germs.

As most people are aware, virtually every household is equipped with a plumber's plunger and most people go to great lengths to disguise the presence of this ubiquitous tool in their bathrooms with varying degrees of success.

As a consequence of the foregoing situation, there has existed a longstanding need for a new and improved support and storage device for the tool commonly referred to as the "plumbing helper" which marries the best qualitites of functionality, practicality and aesthetic appearance; and, the provision of such an arrangement is the stated objective of the present invention.

BRIEF SUMMARY OF THE INVENTION

Briefly stated, the support and storage device for a plumber plunger that forms the basis of the present invention comprises in general a base unit, a front cover unit, and a drying unit formed integrally with the base unit used to support, dry, and attractively conceal the familiar profile of a plumber's plunger.

As will be explained in greater detail further on in the specification, the base unit includes a generally truncated cylindrical base housing member having cylindrical sidewalls connected to a floor panel by a tapered skirt element wherein the floor panel is provided with a plurality of support legs.

In addition, the front cover unit is intended and dimensioned to cover the front portion of the base housing member to conceal the operative portions of the plunger with the exception of the plunger handle.

Furthermore, the front cover unit comprises a contoured cover member having a semi-frustro conical upper portion which combine to produce an aesthetically pleasing visual effect.

It should further be mentioned that the support and storage device further includes an enhanced air circulation drying feature involving only three drying ribs projecting upwardly from and formed integrally with the floor panel of the base housing member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
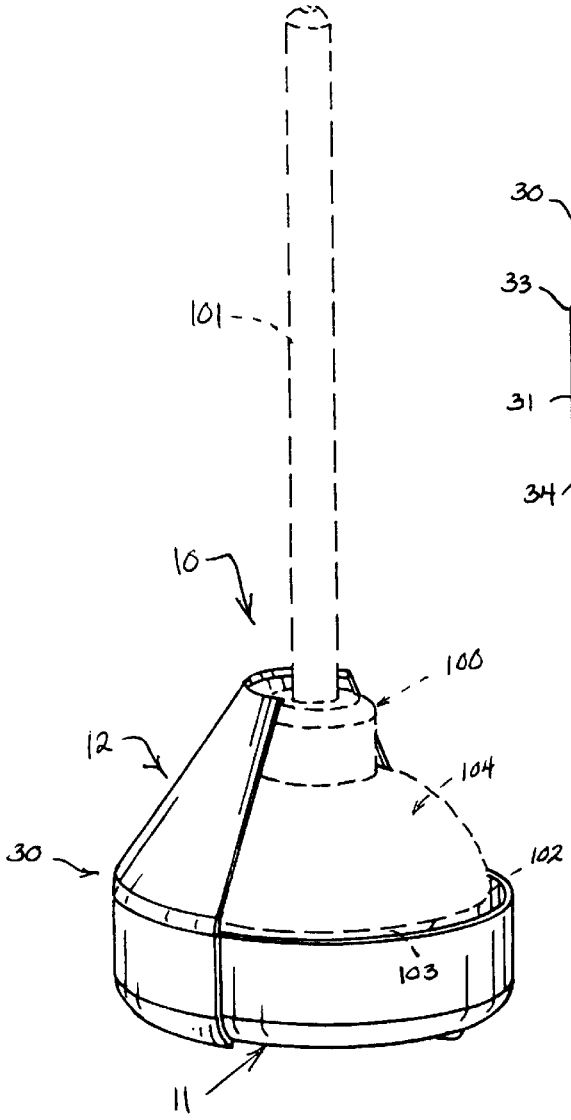
FIG. 1 is a perspective view of the support and storage device operatively deployed with a plumbing plunger.

As can be seen by reference to the drawings, and in particular to FIG. 1, the support and storage device for plumber's plungers that forms the basis of the present invention is designated generally by the reference number 10. The device 10 comprises in general a base unit 11, a front cover unit 12 and a dryer unit 13. These units will now be described in seriatim fashion.

As can best be seen by reference to FIGS. 2 through 5, the base unit 11 comprises a generally hollow truncated cylindrical base housing member 20 having a generally flat circular floor panel 12 supported on its bottom surface 22 by a plurality of generally soft rubber or integrally formed plastic support legs 23.

In addition, the floor panel 21 is further connected to the cylindrical sidewalls 24 of the base housing member 20 by an outwardly flared skirt element 25.

Still referring to FIGS. 2 through 5, it can be seen that the front cover unit 12 comprises a front cover member 30 having a generally semi-cylindrical lower portion 31 and a generally semi-frustro-conical upper portion 32 connected to one another by a curved semi-circular intermediate portion 33 wherein the semi-cylindrical lower portion 31 of the front cover member 30 overlies approximately one-half of the cylindrical sidewalls 24 of the base housing member 20 and has an inwardly and downwardly depending skirt element 34 that overlies and extends below the skirt element 25 of the base housing member 20 to conceal the support legs 23 on the base housing member 20 as viewed from the front at ground level.

In addition, as shown in FIGS. 1 through 4, the generally semi-circular opening 35 on the top portion 32 of the front cover member 30 is dimensioned to receive and closely conform to one side of the plunger handle 101 wherein the widest 102 and the lower portion 103 of the plunger member 100 is dimensioned to be received in the base housing member 20 the inwardly tapered upper portion 104 of the plunger 100 is designed to closely conform to the upper portion 32 of the front.

Figure 2:
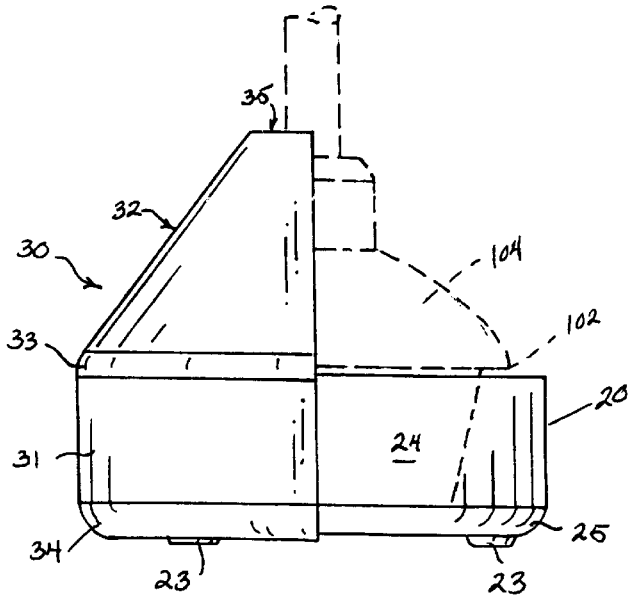
FIG. 2 is a side elevation view of the device.

Turning now to FIG. 2, it can be seen that the dryer unit 12 is formed integrally with the base housing member 20 and comprises a plurality of radially arrayed non-connected drying ribs 40 projecting upwardly from the upper surface

28 of the floor panel 21 to allow air circulation to effect the drying out of the interior of the plunger chamber.

Figure 3:
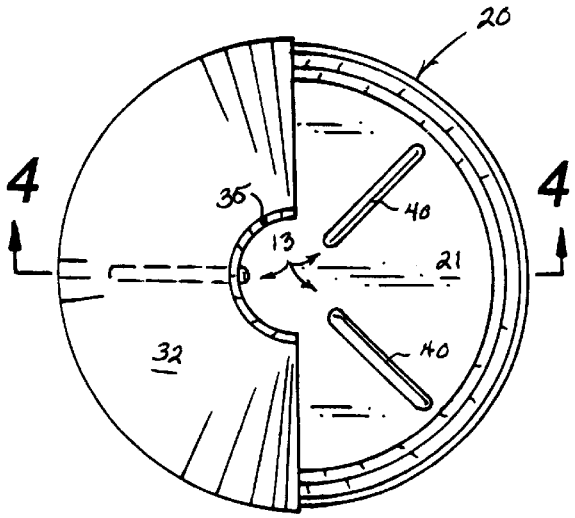
FIG. 3 is a top plan view of the device.
Figure 4:
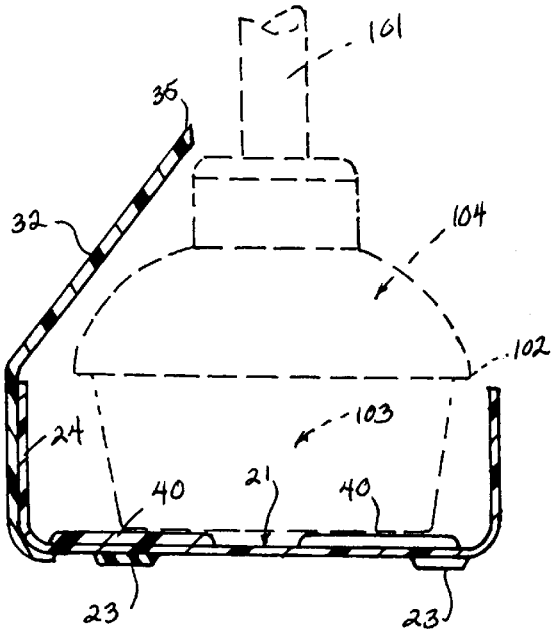
FIG. 4 is a cross-sectional view taken through line 4—4 of FIG. 3.
Figure 5:
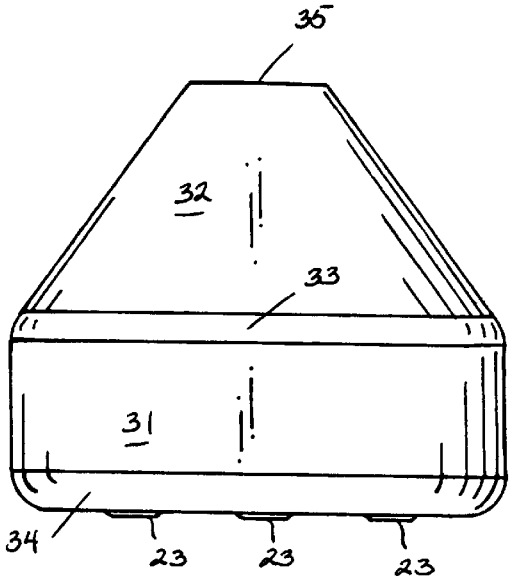
FIG. 5 is a front elevation view of the device.
Figure 6:
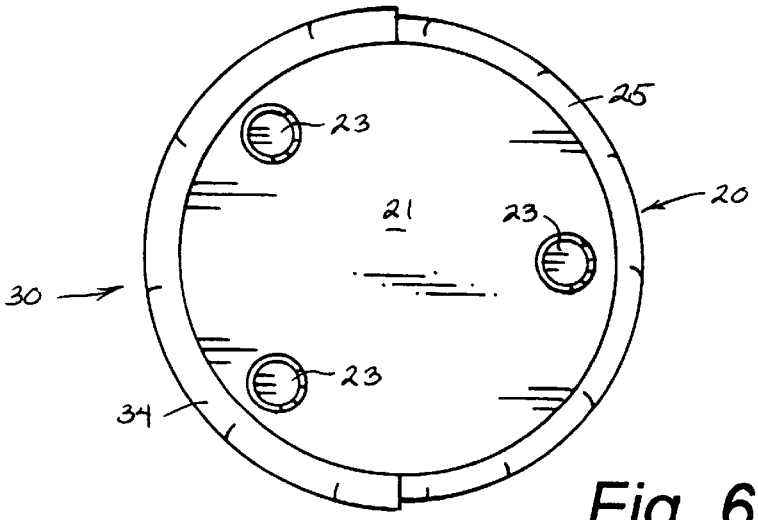
FIG. 6 is a bottom plan view of the device.

It should further be noted at this junction that in the preferred embodiment of the invention illustrated in FIG. 3, there are only three drying ribs 40 employed, since this is the minimum number of ribs both required to support the bottom of the plunger 100 and to allow the maximum amount of air circulation there between.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

We claim:

1. A support and storage device for the unobtrusive storage and/or hidden display of a plumber's plunger having a plunger handle connected to the upper portion of a conventional plunger whose lower portion tapers inwardly from the widest circumference of the plunger wherein the support and storage device comprises:

a generally truncated cylindrical base housing member including a floor panel having a top surface and a bottom surface and generally cylindrical sidewalls associated with and projecting upwardly with respect to said floor panel; wherein, the bottom surface of the floor panel is provided with a plurality of support legs; wherein, the sidewalls of the base housing member are connected to the floor panel by a skirt element; and a front cover unit operatively associated with said base housing member and including a generally semi-cylindrical lower portion and a generally semi-frustro conical upper portion;

wherein, the lower portion of the front cover member is provided with a downwardly depending skirt element that extends below the skirt element of the base housing member.

2. The device as in claim 1; wherein, the top surface of the floor panel is provided with a plurality of drying ribs.

3. The device as in claim 2; wherein, said drying ribs are formed integrally with said floor panel.

4. The device as in claim 3; wherein, the maximum number of drying ribs is three.

5. The device as in claim 1; wherein, the semi-cylindrical lower portion of the front cover member is connected to the semi-frustro conical upper portion of the front cover member by a curved generally semi-circular intermediate portion.

6. The device as in claim 5; wherein, said drying ribs are formed integrally with said floor panel.

* * * * *